United States Patent [19]

Murata

[11] 4,112,822

[45] Sep. 12, 1978

[54] PRESSURE RESPONSIVE SEQUENCING DEVICE

[75] Inventor: Hikaru Murata, Gifu, Japan

[73] Assignee: Kayabakogyokabushikikaisha, Tokyo, Japan

[21] Appl. No.: 584,586

[22] Filed: Jun. 6, 1975

[51] Int. Cl.[2] ..... F15B 11/20; F15B 13/07

[52] U.S. Cl. ..... 91/29; 91/412; 91/420

[58] Field of Search ..... 91/6, 29, 412, 421, 91/420, 451, 455, 468, 28

[56] References Cited

U.S. PATENT DOCUMENTS

| | | | |
|---|---|---|---|
| 1,908,504 | 5/1933 | Bone | 91/455 X |
| 1,994,974 | 3/1935 | Wiedmann | 91/412 X |
| 2,549,979 | 4/1951 | Lane | 91/463 X |
| 2,598,233 | 5/1952 | Deardorff | 91/412 |
| 2,778,378 | 1/1957 | Presnell | 91/412 X |
| 2,825,309 | 3/1958 | Geiger | 91/412 X |
| 2,857,874 | 10/1968 | McBride, Jr. | 91/412 X |
| 2,974,637 | 3/1961 | Holmes et al. | 91/443 X |
| 2,987,886 | 6/1961 | Deering et al. | 91/412 X |
| 3,202,060 | 8/1965 | Grotness | 91/443 |
| 3,507,298 | 4/1970 | Ratliff | 137/106 |
| 3,628,558 | 12/1971 | Bahl | 91/412 X |
| 3,871,266 | 3/1975 | Schwab | 91/412 |
| 3,884,253 | 5/1975 | Murata et al. | 137/110 |

FOREIGN PATENT DOCUMENTS

| | | | |
|---|---|---|---|
| 915,661 | 7/1946 | France | 91/412 |
| 2,011,996 | 10/1971 | Fed. Rep. of Germany | 91/420 |

*Primary Examiner*—Irwin C. Cohen
*Attorney, Agent, or Firm*—Saul Jecies

[57] ABSTRACT

A pressure responsive sequence device wherein in order to carry out the pressure responsive sequencing operation in both the meter-in and meter-out flow control modes, between a supply line and a discharge line of a primary actuator is inserted a switching valve which automatically switches, in response to the pressure difference between the supply and discharge lines, to communicate either of them having a lower pressure than the other with a tank through a low pressure relief valve; and a sequencing valve is inserted in a supply line which communicates a pump in a hydraulic power source with a secondary actuator.

2 Claims, 18 Drawing Figures

FIG.6
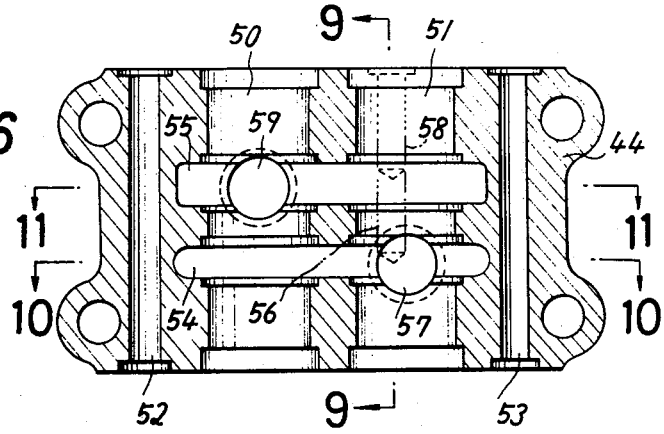
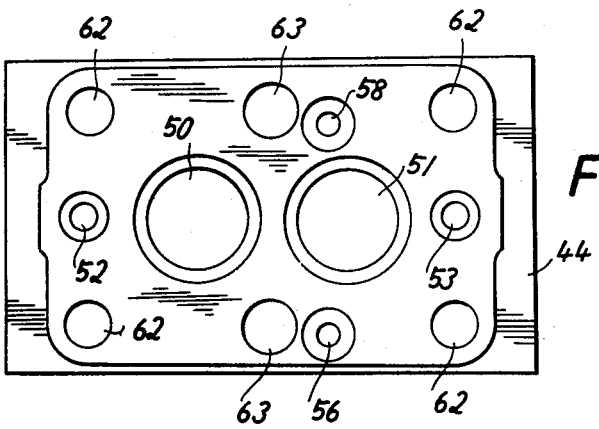
FIG.7
FIG.8
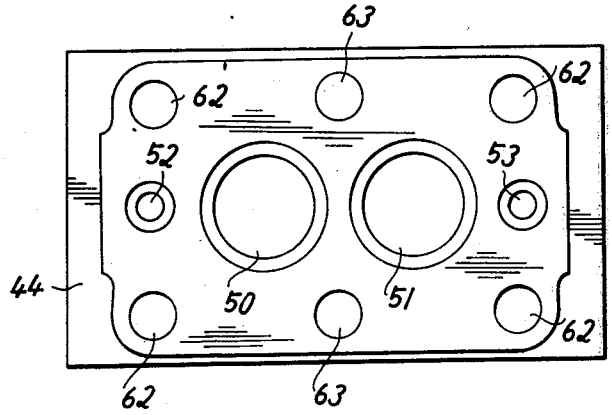

FIG. 9
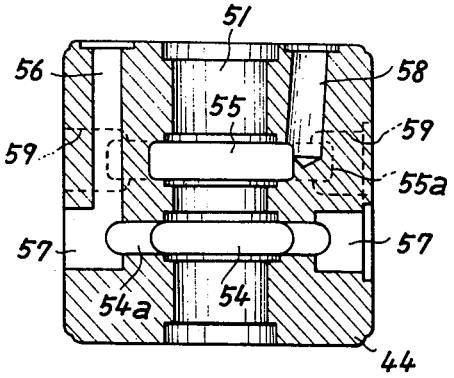
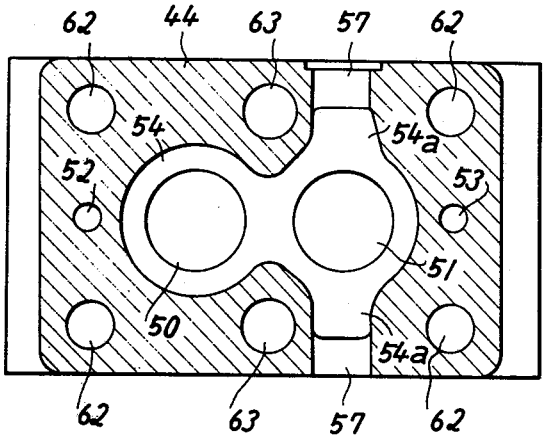
FIG. 10
FIG. 11
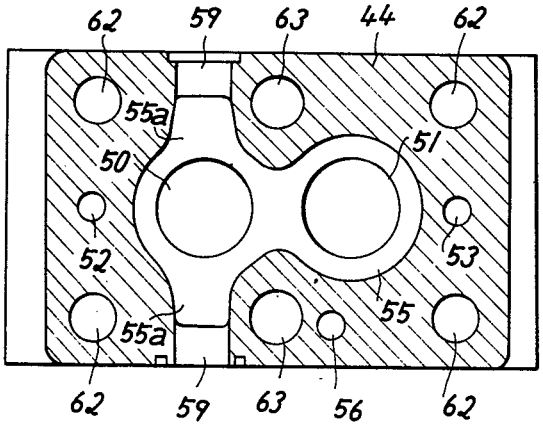

FIG.12
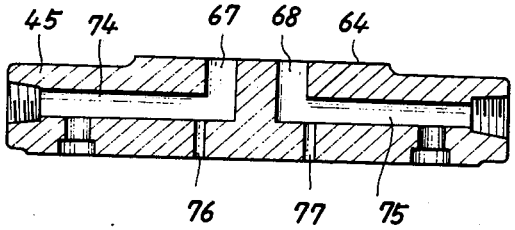
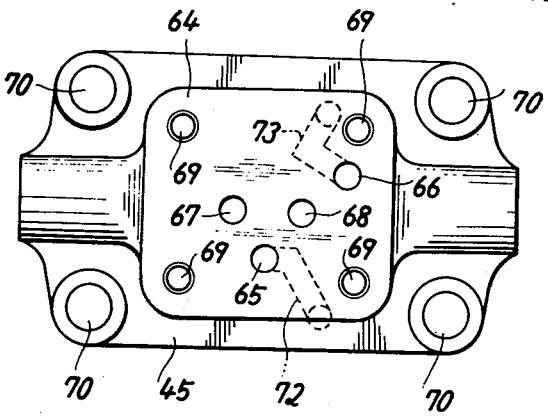
FIG.13
FIG.14
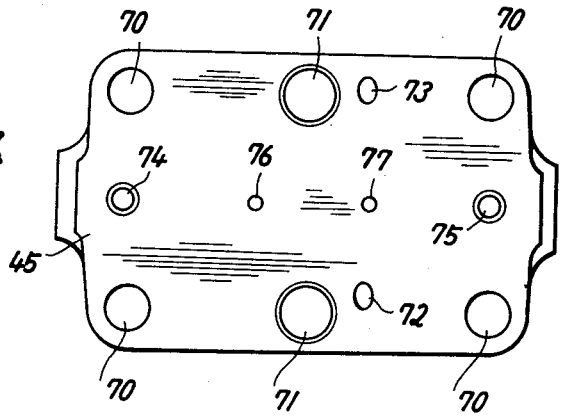
FIG.15
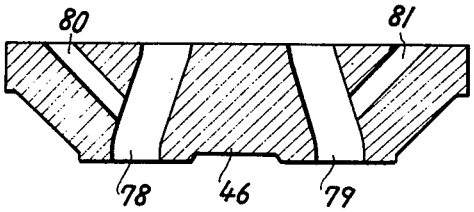

FIG.16
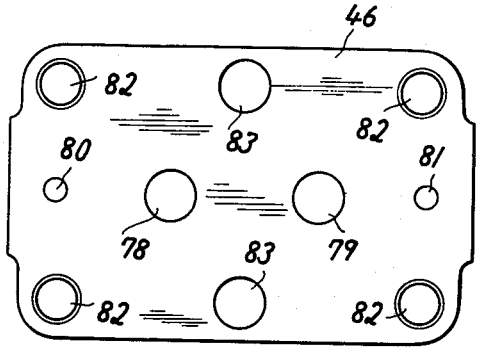
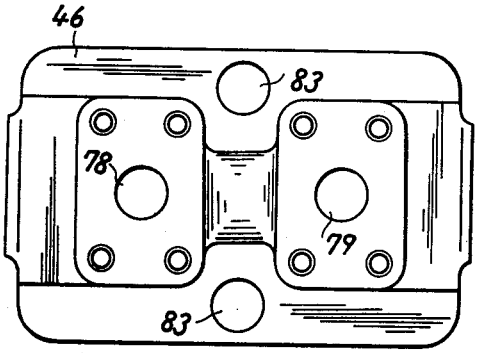
FIG.17
FIG.18
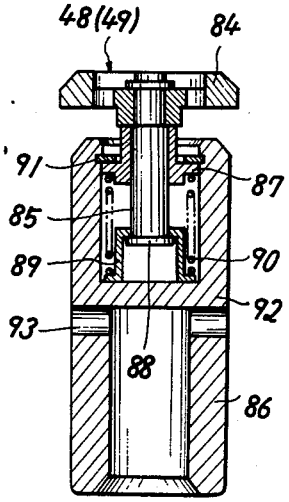

PRESSURE RESPONSIVE SEQUENCING DEVICE

BACKGROUND OF THE INVENTION

The present invention relates to generally a pressure responsive sequencing device for use in hydraulic actuating system and more particularly a pressure responsive sequencing device which may accomplish the sequential operations even in the meter-out flow control mode.

In general, the pressure responsive sequential control is possible only in a hydraulic system which may be maintained in the meter-in flow control mode over the whole operation of a primary actuating circuit, but it is very difficult to attain the pressure responsive sequential control in a hydraulic system which is switched to the meter-out flow control mode. The reason is that when the whole operation of the primary actuator circuit is controlled in the meter-in flow control mode, the supply pressure to the primary actuator circuit is suddenly increased when the operation of the primary actuator circuit has been accomplished so that when the set pressure of a sequencing valve inserted into a supply line to a secondary actuator circuit which is branched from the supply line from the primary actuator circuit is set slightly higher than the load pressure produced in the primary actuator circuit, the sequencing valve may be opened immediately when the operation of the primary actuator circuit has been accomplished whereby the so-called pressure responsive sequential control for starting the operation of the secondary actuator circuit may be attained. When the speed of the load is controlled in the hydraulic actuating system in such a way that the load which is at rest is accelerated to a predetermined speed, maintained at this speed for a predetermined time to accomplish a desired work, then decelerated and stopped, the meter-in control must be accomplished during the acceleration in which the direction of the load is positive, and when the direction of the load is reversed to negative and then the load is decelerated, the flow control must be switched to the meter-out control system. In such hydraulic control system, the supply pressure rises to the set pressure of the relief valve as soon as the hydraulic actuating system has been switched to the meter-out flow control. Therefore when the sequencing valve is inserted in the supply line to the secondary actuator circuit, it is immediately opened when the primary actuator circuit is changed to the meter-out flow control mode so that an erratic operation of the secondary actuator circuit may be started.

SUMMARY OF THE INVENTION

In view of the above, one of the objects of the present invention is to provide a novel pressure responsive sequencing device which may start the operation of a secondary actuator circuit when and only when the operation of a primary actuator circuit has been accomplished not only in the hydraulic actuating system in which the whole operation of the primary actuator circuit is accomplished under the meter-in flow control or under the meter-out flow control but also in the hydraulic control system in which the direction of the load is reversed to the negative during the operation of the primary actuator circuit and then the meter-in flow control is switched to the meter-out flow control.

Another object of the present invention is to provide a pressure responsive sequencing device especially adapted for use in a large-capacity hydraulic control system.

To attain the above and other objects, according to the present invention, in a primary actuator circuit between a supply line downstream of a meter-in flow control valve and a discharge or return line upstream of a meter-out flow control valve is inserted a switching valve which is automatically switched in response to the pressure difference between the supply and discharge or return lines in such a way that either of the supply or discharge line having a lower pressure than the other may be communicated through a low pressure relief valve with a tank; and the supply line of the primary actuator circuit is communicated through a sequencing valve with a supply line to a secondary actuator circuit.

As far as the direction of the load exerted to the primary actuator circuit is positive and the meter-in flow control is continued, the switching valve is maintained in the position in which the discharge or return line is communicated through the low pressure relief valve with the tank. When the operation of the primary actuator circuit is accomplished so that the pressure in the supply line is quickly increased, the sequencing valve is opened so that the operation of the secondary actuator circuit may be started. When the direction of the load exerted to the primary actuator circuit is reversed to the negative and the meter-in flow control is switched to the meter-out flow control mode, the pressure in the discharge or return line increases above the pressure in the supply line so that the switching valve is switched to communicate the supply line through the low pressure relief valve with the tank. Therefore the maximum pressure in the supply line is checked by the low pressure relief valve so that the erratic opening of the sequencing valve may be prevented. When the operation of the primary actuator circuit has been accomplished, no working oil flows through the discharge or return line so that the pressure therein drops. As a result the switching valve automatically communicates the discharge or return line through the relief valve with the tank so that the pressure in the supply line immediately increases, opening the sequencing valve so as to start the operation of the secondary actuator circuit. Thus, the pressure responsive sequential control in which the operation of the secondary actuator circuit is started immediately after the completion of the operation of the primary actuator circuit regardless of the direction of the load in the primary actuator circuit may be accomplished.

According another aspect of the present invention, the primary and secondary actuator circuits incorporate amplifier valve assemblies which may product the main flow which is amplified with respect to the pilot flow at a ratio in proportion to the ratio of the opening area of a detector orifice inserted into the pilot flow passage to the opening area of a main orifice inserted into the main flow passage. The pilot flow circuit of the amplifier valve assembly is hydraulically and operatively communicated with a pilot meter-in flow control valve, a pilot flow meter-out flow control valve, a switching valve, a low pressure valve and a sequencing valve so that the pressure responsive sequencing device adapted for use in a large-capacity hydraulic control system may be provided.

The above and other objects, features and advantages of the present invention will become more apparent from the following description of some preferred embodiments thereof taken in conjunction with the accompanying drawings.

BRIEF DESCRIPTION OF THE DRAWING

FIG. 6 is a sectional view of a body section thereof;

FIG. 7 is a top view thereof;

FIG. 8 is a bottom view thereof;

FIG. 9 is a longitudinal section view taken along the line 9—9 of FIG. 6;

FIGS. 10 and 11 are sectional views taken along the lines 10—10 and 11—11 of FIG. 6;

FIG. 12 is a sectional view of an upper cover of the amplifier valve assembly shown in FIG. 3;

FIG. 13 is a top view thereof;

FIG. 14 is a bottom view thereof;

FIG. 15 is a sectional view of a lower cover of the amplifier valve assembly shown in FIG. 3;

FIG. 16 is a top view thereof;

FIG. 17 is a bottom view thereof;

FIG. 18 is a longitudinal sectional view of a valve spool inserted into the body section shown in FIGS. 6 through 8 of the amplifier valve assembly.

DESCRIPTION OF THE PREFERRED EMBODIMENT

Figure 1:
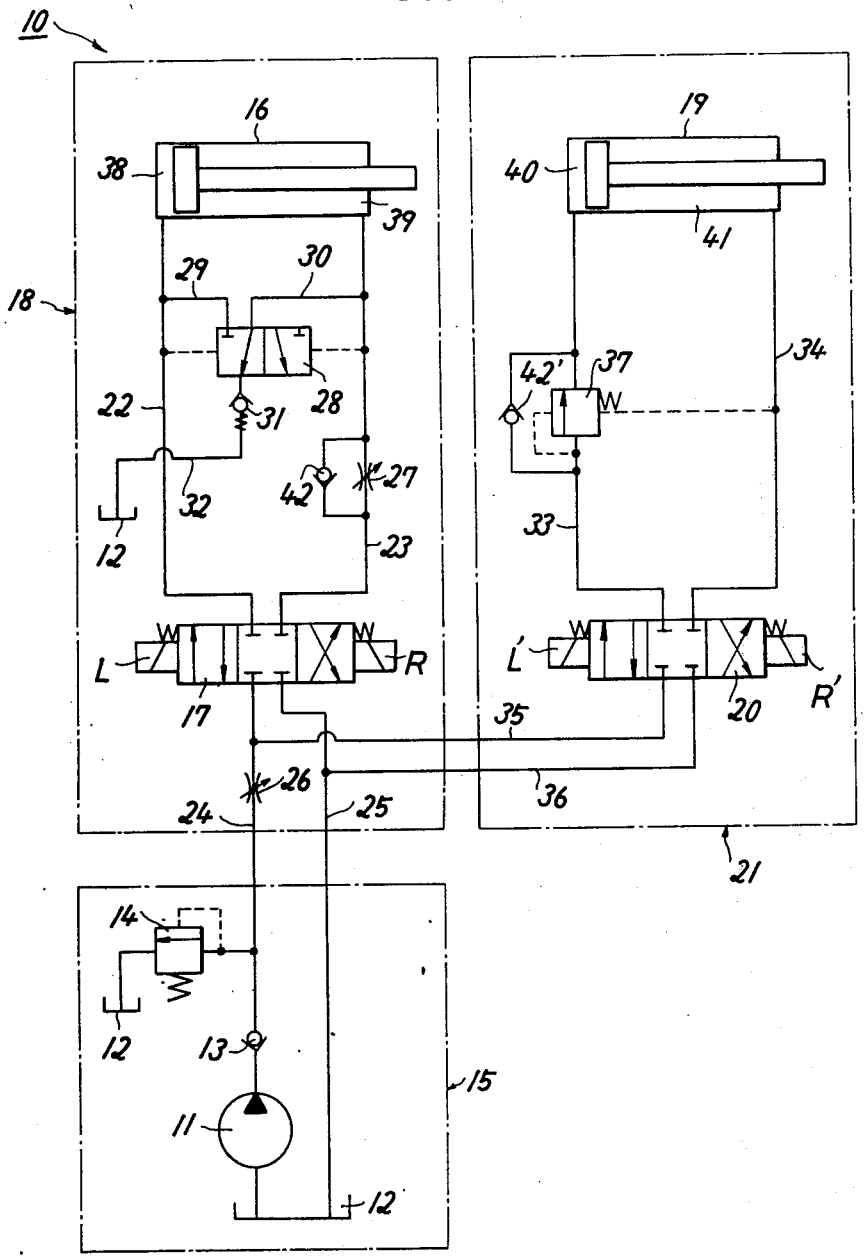
FIG. 1 is a diagram of a fundamental hydraulic circuit of a pressure responsive sequencing device in accordance with the present invention.

Fundamental Hydraulic Circuit, FIG. 1

In FIG. 1 there is shown a fundamental hydraulic circuit of a pressure responsive sequencing device of the present invention generally indicated by the reference number 10 and comprised of hydraulic power source 15 comprising a pump 11, a tank 12, a load check valve 13 and main relief valve 14; a primary actuator circuit 18 comprising an actuator 16, and a closed center, four-port, three-position solenoid operated valve 17; and a secondary actuator circuit 21 comprising an actuator 19, and a closed center, four-port, three-position solenoid operated valve 20.

Two lines 22 and 23 in communication with the actuator 16 in the primary actuator circuit 18 are selectively communicated through the solenoid operated valve 17 with a line 24 in communication with the pump 11 or a return line 25 in communication with the tank 12 in the power source 15. A meter-in flow control valve 26 is inserted in the supply or high pressure line 24, and a meter-out flow control valve 27 is inserted in the line 23. Between the lines 22 and 23 is inserted a switching valve 28 which may automatically communicate the low pressure line 22 or 23 through a line 29 or 30 and a low pressure relief valve 31 and a line 32 with the tank 12.

Two lines 33 and 34 in communication with the actuator 19 in the secondary actuator circuit 21 are selectively communicated by the solenoid operated valve 20 with a high pressure or supply line 35 branched from the high pressure line 24 and a discharge or return line 36 branched from the discharge line 25 which in turn is in communication with the tank 12. A sequencing valve 37 is inserted in the line 33.

When the solenoids L and L′ of the solenoid operated valves 17 and 20 of the primary and secondary actuator circuits 18 and 21 are energized to switch the valves 17 and 20 to the left position, the hydraulic liquid under pressure discharged from the pump 11 flows through the supply line 24, the meter-in flow control valve 26, the solenoid operated valve 17 and the line 22 into the left chamber 38 of the actuator 16 while the working oil in the right chamber 39 in the actuator 16 returns through the line 23, the meter-out flow control valve 27, the solenoid operated valve 17 and the discharge line 25 to the tank 12. Thus the stroke of the primary actuator circuit 18 is started. When the load is exerted to the actuator 16 in the positive direction, the pressure in the line 22 becomes higher than the pressure in the line 23 so that the switching valve 28 is automatically switched to the left position shown in FIG. 1 and is held in this position so as to communicate the line 23 through the line 30, the switching valve 28, the low pressure relief valve 31 and the line 32 with the tank 12. Therefore, it becomes possible to make the flow rate set by the meter-in flow control valve 26 in the supply line 24 larger than the flow rate set by the meter-out flow control valve 27 in the line 23 because working oil under pressure equal in quantity to the difference between the flow rates set by the meter-in and meter-out flow control valves 26 and 27, flows from the line 23 through the switching valve 28 into the low pressure relief valve 31, where the working oil is maintained at a low pressure, and then into the tank 12 so that the meter-out flow control valve 27 is not actuated. The actuator 16 in the primary actuator circuit 18 is therefore actuated at a speed controlled by the meter-in flow control valve 26.

The set pressure of the sequencing valve 37 in the secondary actuator circuit 21 is greater than the load pressure generated in the supply line 24 in the meter-in flow control operation of the primary actuator circuit 18 so that the actuator 19 in the secondary actuator circuit 21 may not be actuated.

When the going stroke of the actuator 16 in the primary actuator circuit 18 is accomplished, the load pressure in the supply line 24 suddenly increases and exceeds the set pressure of the sequencing valve 37 so that the working oil under pressure discharged from the pump 11 flows through the supply line 24, the branched supply line 35, the solenoid valve 20 and the line 33 into the sequencing valve 37 and then into the left chamber 40 of the actuator 19 of the secondary actuator circuit 21. The working oil in the right chamber 41 of the actuator 19 is forced to return through the line 34, the solenoid valve 20, the branched discharge line 36, and the discharge line 25 to the tank 12. Thus, the stroke of the secondary actuator circuit 21 is started.

When the load is exerted to the actuator 16 in the negative direction or the direction of the load is reversed from the negative to the positive direction during the stroke the actuator 16, the meter-out flow control valve 27 inserted in the line 23 is actuated to prevent the free running of the actuator 16. That is, the actuator 16 is actuated under the control of the meter-out flow control valve 27. Under the above condition, the counter pressure is generated in the section of the line 23 between the right chamber 39 of the actuator 16 and the meter-out flow control valve 27. When the counter pressure rises above the pressure in the line 22, the switching valve 28 is automatically switched and pressure in secondary actuator circuit 21 is greater than the load pressure generated in the supply line 24 in the meter-in flow control operation of the primary actuator circuit 18 so that the actuator 19 in the secondary actuator circuit 21 may not be actuated.

When the going stroke of the actuator 16 in the primary actuator circuit 18 is accomplished, the load pressure in the supply line 24 suddenly increases and exceeds the set pressure of the sequencing valve 37 so that the working oil under pressure discharged from the pump 11 flows through the supply line 24, the branched supply line 25, the solenoid valve 20 and the line 33 into the sequencing valve 27 and then into the left chamber 40 of the actuator 19 of the secondary actuator circuit 21. The working oil in the right chamber 41 of the actuator 19 is forced to return through the line 34, the solenoid valve 20, the branched discharge line 36, and the discharge line 25 to the tank 12. Thus, the stroke of the secondary actuator circuit 21 is started.

When the load is exerted to the actuator 16 in the negative direction or the direction of the load is reversed from the negative to the positive direction during the stroke of the actuator 16, the meter-out flow control valve 27 inserted in the line 23 is actuated to prevent the free running of the actuator 16. That is, the actuator 16 is actuated under the control of the meter-out flow control valve 27. Under the above condition, counter pressure is generated in the section of the line 23 between the right chamber 39 of the actuator 16 and the meter-out flow control valve 27. When the counter pressure rises above the pressure in the line 22, the switching valve 28 is automatically switched to the right position so that the line 22 is communicated through the low pressure relief valve 31 with the tank 12. The maximum pressure in the line 24 is therefore limited by the low pressure relief valve 31. When the set pressure of the low pressure relief valve 31 is lower than the set pressure of the sequencing valve 37, the latter will not be opened so that the operation of the secondary actuator circuit 21 may not be started. At the end of the stroke of the actuator 16 in the primary actuator circuit 18, no working oil flows through the meter-out flow control valve 27 so that the counter pressure in the line 23 between the right chamber 39 and the meter-out flow control valve 27 suddenly drops. As a result, the switching valve 28 is switched back to the left position to communicate the line 23 through the low pressure relief valve 31 with the tank 12. Then the pressure in the supply line 24 suddenly increases, and when it exceeds the set pressure of the sequencing valve 37, the latter is opened so that the working oil under pressure from the pump 11 flows into the left chamber 40 of the actuator 19 of the secondary actuator circuit 21. Thus the operation of the secondary actuator circuit 21 is started.

The return strokes of the actuators 16 and 19 are effected when the right solenoids R and R' thereof are energized to switch them to the right position. The working oil under pressure discharged from the pump 11 flows through the supply line 24, the solenoid operated valve 17, a check valve 42 inserted in parallel with the meter-out flow control valve 27 and the line 23 into the right chamber 39 of the actuator 16. The working oil under pressure is also forced into the right chamber 41 of the actuator 19 in the secondary actuator circuit 21.

Therefore, the working oil in the chambers 38 and 40 of the actuators 16 and 19 are forced to return to the tank 12 through the lines 22 and 33, a check valve 42' inserted in parallel with the sequencing valve 37 in the line 33, the solenoid operated valves 17 and 20 and the discharge line 25. The plungers of the actuators 16 and 19 are retracted, and the primary and secondary actuator circuits 18 and 21 are returned to the initial position.

In summary, in the pressure responsive sequencing device 10 with the above construction, the meter-in or meter-out flow control is automatically selected depending upon whether the load is exerted to the primary actuator circuit 18 in the position or negative direction, and regardless of the direction of the load exerted to the primary actuator circuit 18, when the latter has completed its stroke, the secondary actuator circuit 21 is started. Thus, the positive pressure responsive sequencing can be effected in an open circuit system.

From the foregoing description, the features of the pressure responsive sequencing device in accordance with the present invention has been clearly understood. However, when a pressure responsive sequencing device with a large capacitor is required, the large-capacity flow control valves, switching valves, low pressure relief valves and sequencing valves must be provided thus resulting in an increase in cost.

FIRST EMBODIMENT

Figure 2:
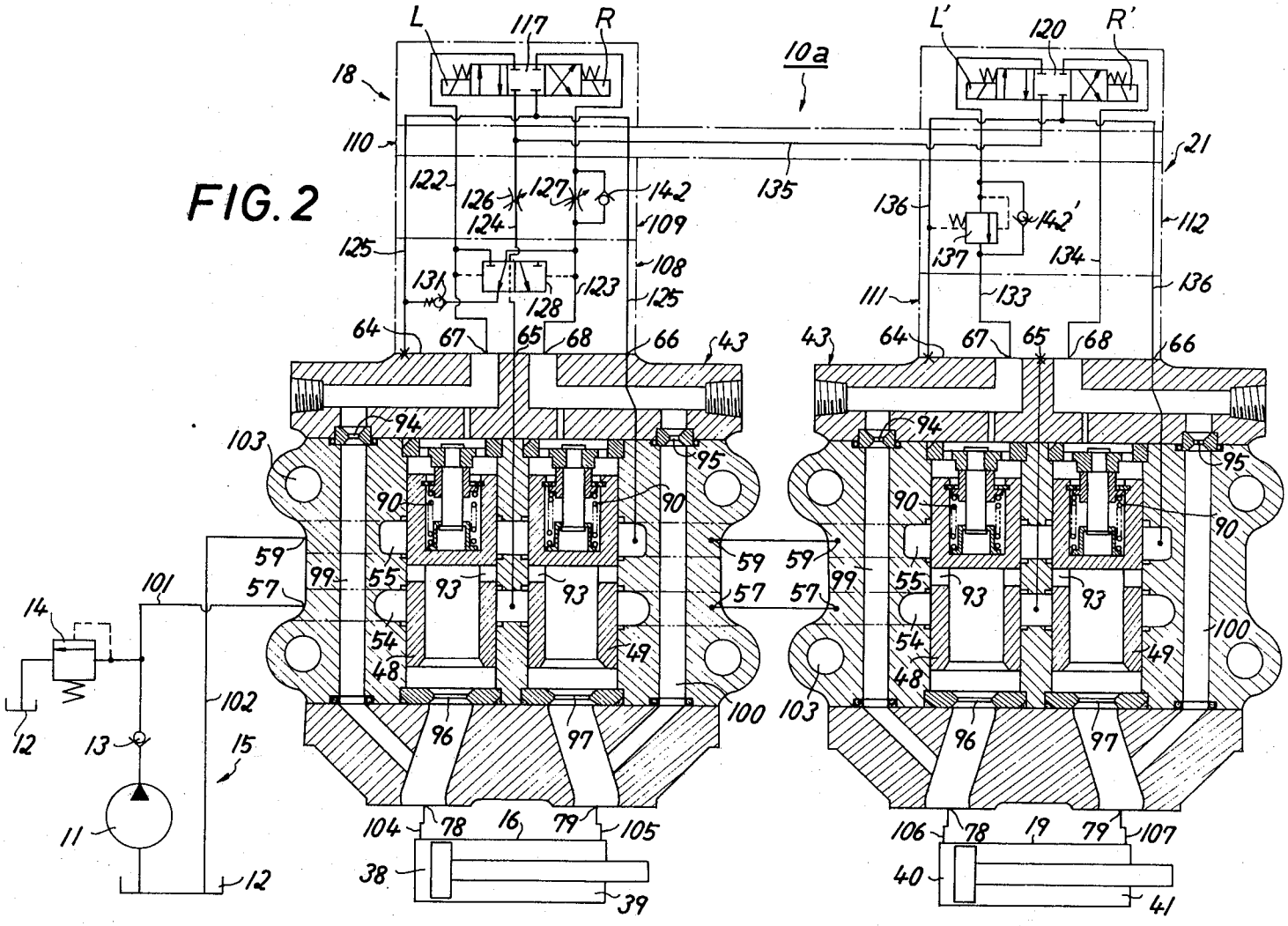
FIG. 2 is a diagram of a hydraulic circuit of a pressure responsive sequencing device of the present invention adapted for use in a large-capacity hydraulic control system.

FIG. 2 shows a large-capacity pressure responsive sequencing device **10*a* of the present invention which may be fabricated at less cost. Amplifier valve assemblies 43 which are exactly similar in construction and are incorporated in the primry and secondary actuator circuits 18 and 21** make up a hydraulic wheatstone bridge, and include various control valves for controlling the pilot flows.

AMPLIFIER VALVE ASSEMBLY FIGS. 3, 4 AND 5

Figure 3:
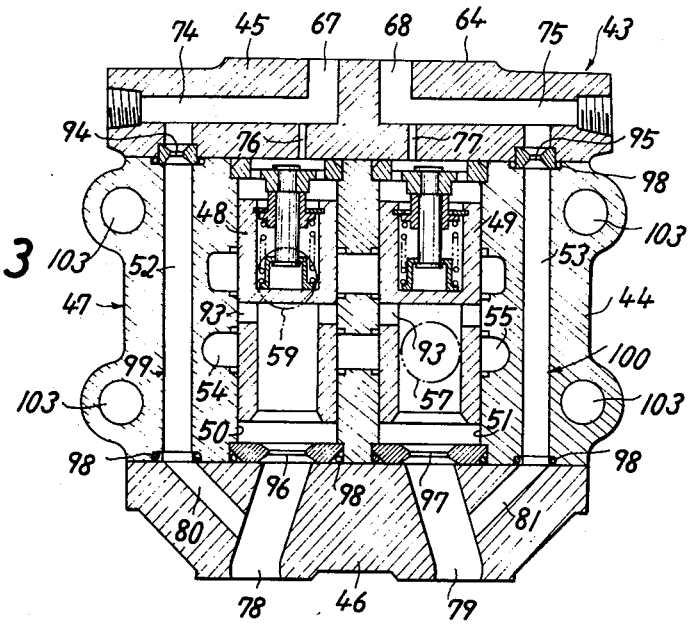
FIG. 3 is a sectional view of an amplifier valve assembly thereof.
Figure 4:
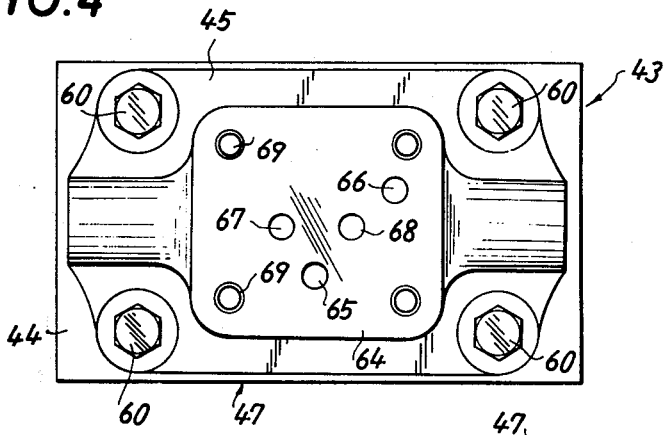
FIG. 4 is a top view thereof.
Figure 5:
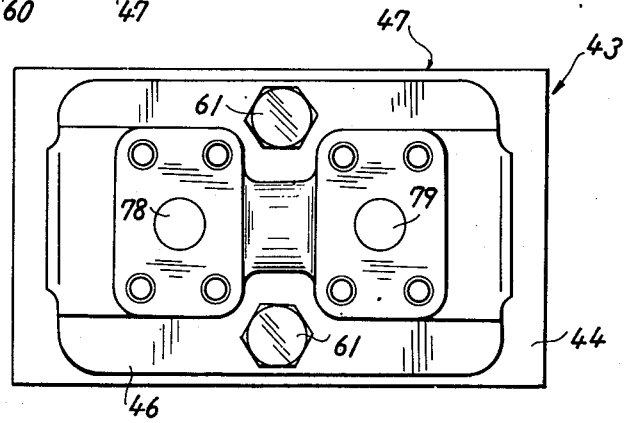
FIG. 5 is a bottom view thereof.

As shown in FIGS. 3, 4 and 5, the amplifier valve assembly 43 comprises a body member 47 consisting of a body section 44, an upper cover 45 and a lower cover 46, and valve spools 48 and 39 mounted in the body section 44.

BODY SECTION 44, FIGS. 6, 7 AND 8

As shown in FIGS. 6 through 8, the body section 44 is provided with two valve chambers 50 and 51 and two passages 52 and 53 which are vertically extended in parallel with each other, two annular grooves 54 and 55 in communication with the valves chambers 50 and 51, a communication passage 56 in communication with ports 57 and the annular groove 54 and a communication passage 58 in communication with ports 29 and the other annular groove 55. One end of the communication passages 56 and 58 is opened at the upper surface of the body section 44 while the other end terminates to the ports 57 or 59 opened at the side surface of the body section 44. As best shown in FIGS. 9 through 11, in order to facilitate the machining of the communication passages 56 and 58 and the ports 57 and 59, the annular grooves 54 and 55 are enlarged at **54*a* and 55*a* towards the ports 57 and 59. From the side surface of the body sections, the ports 57 and 59 are drilled to communication with the enlarged portions 54*a* and 55*a*, respectively and the communication passage 56 is drilled vertically from the upper surface of the body section 44 to communicate with the enlarged portion 54*a* of the lower annular groove 54. In like manner, the communication passage 58 is drilled at a small angle relative to the vertical from the top surface of the body section 44 so as to be communicated with the enlarged portion 55***a* of the upper annular groove 55. Furthermore, the body section 44 is provided with vertical through bolt holes 62 and 63 through which are extended through bolts 60 and 61 for assemblying the body section 44 with the upper and lower covers 45 and 46 (See FIGS. 4 and 5).

UPPER COVER, FIGS. 12 THROUGH 14

As shown in FIGS. 12 through 14, the upper cover 45 has a mounting seat 64 formed on the top surface thereof, and a pilot intake port 65, a pilot discharge port 66, two pilot ports 67 and 68 and screw holes for attachment of a pilot valve are formed through the upper cover 45 at the mounting seat 64 thereof in alingment with the corresponding ports and screw holes of a standardized solenoid controlled valve. The upper cover 45 is further provided with bolt holes 70 and screw holes 71 in alingment with the corresponding holes 62 and 63 of the body section 44. When the upper cover 45 is attached to the body section 44, the intake port 65, the discharge port 66 and two pilot ports 67 and 68 are communicated with teh communication passages 56 and 58 and the passages 52 and 53, respectively, of the body section 44 through passages 72, 73, 74 and 75, respectively, formed through the upper cover 45. As best shown in FIG. 3, the passages 74 and 75 in communication with the pilot ports 67 and 68, respectively, are communicated through damper orifices 76 and 77, respectively, with the upper ends of the valve chambers 50 and 51, respectively, of the body section 44.

LOWER COVER 46, FIGS. 15 THROUGH 17

As shown in FIGS. 15 through 17, the lower cover 46 is provided with two ports 78 and 79 extended through the lower cover 46, passages 80 and 81 which are branched from the ports 78 and 79, respectively, and opened at the upper surfce of the upper cover 46, screw holes 82, and bolt holes 83 in alignment with the through holes 62 and 63 of the body section 44. When the lower cover 46 is attached to the main body section 44, the ports 78 and 79 are communicated with the lower ends of the valve chambers 50 and 51, respectively, of the body section 44 while the branched passage 80 and 81 are communicated with the passages 52 and 53, respectively, of the body section 44.

VALVE SPOOL 48 AND 49, FIG. 18

Since the valve spools 48 and 49 are identical in construction, only the valve spool 48 will be described. A guide rod 85 which is fitted into a spool body 86 has its upper end terminated into a bush 84 and its lower end terminated into a flange 88. A center spring 90 is loaded between an upper spring seat 77 fitted over the guide rod 85 and a lower spring seat 89 received by the flange 88 of the guide rod 85. The upper spring seat 87 is retained in position by a snap ring 91 fitted into the spool body 86, and the lower spring seat 89 is pressed against a partition wall 92 of the spool body 86 so that the bush 84 may be normally held in the predetermined relative position with respect to the spool body 86 under the force of the center spring 90. Passages 93 are formed through the side wall of the spool body 86 below the partition wall 92 thereof.

AMPLIFIER VALVE ASSEMBLY

Referring back to FIGS. 3 through 5, the valve spools 48 and 49 are inserted into the valve chambers 50 and 51, respectively, of the body section 44; orifices 94 and 95 are inserted into the passages 74 and 75, respectively, of the upper cover 45; and main orifices 96 and 97 are attached at the lower ends of the valve chamber 50 and 51. Packings 98 are inserted between the upper and lower covers 45 and 46 on the one hand and the body section 44 on the other hand, and the upper cover 45, the body section 45 and the lower cover 46 are assembled into a unitary construction with the though bolts 60 and 61. The ports 78 and 79 of the lower cover 46 are communicated through the main orifices 96 and 97, respectively, when the lower ends of the valve chambers 50 and 51, respectively, of the main body section 44, and the passages 74 and 75 of the upper cover 45 are communicated through the damper orifices 76 and 77, respectively, with the upper ends of the valve chambers 50 and 51, respectively. The pilot ports 67 and 68 of the upper cover 45 are communicated with the pilot ports 78 and 79, respectively, of the lower cover 46 through a pilot passage 99 made up of the passages 80, 52 and 74 and a pilot passage 100 made up of the 81, 53, 75. The ports 75 of the body section 44 are communicated through the lower annular groove 54, the passages 56 and 72 with the intake port 65 of the upper cover 45, and the ports 59 of the body section 44 are communicated through the upper annular groove 55 and the passages 58 and 73 with the discharge port 66 of the upper cover 45. The passages 93 of the valve spools 48 and 39 are located in the neutral position between the upper and lower annular grooves 55 and 54 as shown in FIG. 3.

PRESSURE RESPONSIVE SEQUENCING DEVICE 10*a*, FIG. 2

Next referring back to FIG. 2 the pressure responsive sequencing device 10*a* incorporating the amplifier valve assemblies 43 with the above construction will be described in more detail. The port 57 of the amplifier valve assembly 43 of the primary actuator circuit 18 is communicated through a line 101 with the pump 11 in the hydraulic power source 15, and the port 59, with the tank 12 through a line 102. The ports 57 and 59 of the amplifier valve assembly 43 of the secondary actuator circuit 21 are communicated to the ports 57 and 59 of the amplifier valve assembly 43 of the primary actuator circuit 18. In FIG. 2, for the sake of the simplicity, the ports 57 and 59 of the amplifier valve assemblies 43 of the primary and secondary actuator circuits 18 and 21 are shown as being communicated with each other through the lines indicated by the solid lines, but is is to be understood that the amplifier valve assemblies 43 are attached to each other in tandem with bolts fitted through bolt holes 103 in such in way that the ports 57 and 59 are directly communicated with each other. The other ports 57 and 59; that is, the openings of the ports 57 and 59 of the valve assembly 43 of the secondary actuator cirucit 21 which are not communicated with the corresponding ports 57 and 59 of the mplifier valve assembly 43 of the secondary actuator circuit 21 which are not communicated with the corresponding ports 57 and 59 of the amplifier valve assembly 43 of the primary actuator circuit 18, are closed with plugs or the like. The ports 78 and 79 of the lower cover 46 of the amplifier valve assembly 43 of the primary actuator circuit 18 are communicated through lines 104 and 105, respectively, with the left and right chambers 38 and 39, respectively, of the actuator 16. In like manner, the lower ports 78 and 79 of the amplifier valve assembly 43 of the secondary actuator circuit 21 are communicated through lines 106 and 107, respectively, with the left and right chambers 40 and 41, respectively, of the actuator 19.

Upon the mounting seat 64 of the top cover 45 of the amplifier valve asembly 43 of the primary actuator circuit 18 is mounted a switching valve assembly 108 on which is in turn mounted a flow control valve assembly 109 upon which is mounted a manifold plate 110 upon which is mounted a closed center, four-port, three-position solenoid operated valve 117. The intake port 65 of the amplifier valve assembly 43 is communicated with a first port of the solenoid operated valve 117 through a line 124 and a meter-in flow control valve 126; the discharge port 66 is communicated with a second port of the solenoid operated valve 117 through a discharge line 125; the pilot port 67 is communicated with a third port of the solenoid operated valve 177 through a line 122; and the other pilot port 68 is communicated with a fourth port of the solenoid operated valve 177 through a line 123 and a meter-out flow control valve 127. Between the lines 122 and 123 is inserted a switching valve 128 similar in both construction and operation to the switching valve 28 described elsewhere with reference to FIG. 1 so that the low pressure line 122 or 123 may be communicated through a low pressure relief valve 133 with the discharge or return line 125.

In like manner, upon the mounting seat 64 of the amplifier valve assembly 43 of the secondary actuator circuit 21 are mounted, in the order named, a height adjustment plate 111 provided with communication holes or the like, a sequencing valve assembly 112, the manifold plate 110 and a closed-center, four-port, three-position solenoid operated valve 120. The intake port 65 of the amplifier assembly 43 of the secondary actuator circuit 21 is closed by the plate 111, and the discharge port 66 is communicated through a discharge line 136 with a first port of the solenoid operated valve 120. The pilot port 67 is communicated through a line 133 and a sequencing valve 137 with a second port of the solenoid operated valve 120, and the pilot port 68, with a third port of the solenoid operated valve 120 through a line 134. A fourth port of the solenoid operated valve 120 is communicated through a supply passage 135 through the manifold plate 110 with the supply line 124 in the primary actuator circuit 18.

When the solenoid operated valves 117 and 120 are de-energized as shown in FIG. 2, no working oil under pressure flows so that the actuators 16 and 19 remain deactivated because the working oil under pressure introduced into the annular grooves 54 in both the amplifier valve assemblies 43 from the pump 11 of the power source 15 cannot flow out as the annular grooves 54 are closed by the valve spools 48 and 49 and because the communication of the intake ports 65 with the annular grooves 54 is prevented by the solenoid operated valve 117 and the plate 111.

When the left solenoids L and L' of the solenoid operated valves 117 and 120 are energized to switch them to the left position, the pilot flow of working oil under pressure flows from the annular groove 54 of the amplifier valve assembly 43 of the primary actuator circuit 18 through the intake port 65, the supply line 124, the meter-in flow control valve 126, the solenoid operated valve 117, the line 122, the pilot port 67, the pilot passage 99, the port 78 and the line 104 into the left chamber 37 of the actuator 16. The working oil in the right chamber 39 of the actuator 16 flows through the line 105, the port 79, the pilot passage 100, the pilot port 68, the line 123, the meter-out flow control valve 127, the solenoid operated valve 117, the discharge passage 125, the discharge port 66, the annular groove 55, the port 59 and the line 102 into the tank 12. Thus, the plunger of the actuator 16 is extended. In response to the pressure difference across the detector orifices 94 and 95 in the pilot passages 99 and 100, the left valve spool 48 moves downward against the spring 90 while the right valve spool 49 moves upward against the spring 90. As a result, the main flow flows from the annular groove 54, the passage 93 of the valve spool 48, the main orifice 96 and, the port 78 (where the main stream joins the pilot flow flowing through the pilot passage 99) into the left chamber 38 of the actuator 16, and the main discharge flow flows from the right chamber 39 of the actuator 16 through the line 105, the port 79, the main orifice 97, the passage 93 through the valve spool 49, the annular groove 55 (where the main stream joins the pilot discharge stream) and the port 59 into the tank 12. The pressure difference across the main orifices 96 and 97 produced by the main supply and discharge flows serves to the pressure difference across the detector orifices 94 and 95 produced by the pilot supply and discharge flows so that the valve spools 48 and 49 remain in the position at which the difference between the pressure difference across the main and detector orifices 96 and 97; and 94 and 95 is in equilibrium with the restoring force of the springs 90. The flow rate Q of the main flow is given by:

$$Q = A/a\, q$$

where

A = opening area of main orifice 96 or 97;

a = opening area of detector orifice 94 or 95; and q = flow rate of pilot flow.

It is therefore understood that the plunger of the actuator 16 is extended under the force of the working oil under pressure introduced into the left chamber 38 which oil consisting of the pilot flow with the flow rate $q$ and the main flow Q which is amplified with respect to the pilot flow at a predetermined ratio ($A/a$). As with the case of the fundamental hydraulic circuit described with reference to FIG. 1, when the load is exerted in the positive direction, the actuator 16 is actuated in the meter-in flow control system, and the switching valve 128 remains in the left position to communicate the line 123, 128 remains in the left position to communicate the line 123 through the low pressure relief valve 131 with the discharge line 125. On the other hand, when the load is exerted in the negative direction or when the direction of the load is reversed to the negative during the operation, the actuator 16 is controlled in the meter-out flow control mode, and the switching valve 128 is switched to the right position so that the line 122 is communicated through the low-pressure relief valve 131 with the discharge line 125.

When the set pressure of the sequencing valve 137 is set to a level higher than both the load pressure produced in the line 124, in the meter -in flow control mode and the set pressure of the low pressure relief valve 131, there is no fear that the operation of the secondary actuator circuit 21 is started due to the opening of the sequencing valve 137 prior to the completion of the stroke of the primary actuator circuit 18 regardless of the fact whether the primary actuator circuit 18 is operated in the meter-in or meter-out control mode.

When the operation or the primary actuator circuit 18 is accomplished, the pressure in the line 124 is immediately increased in the meter-in flow control mode or the pressure in the supply line 124 is increased immediately after the switching valve 128 is switched to the left position in the meter-out flow control mode. When the pressure in the supply line 124 exceeds the set pressure of the sequencing valve 137, the pilot flow flows through the supply line 124, the branched supply line 135, the solenoid operated valve 120, the passage 133, the sequencing valve 137, the pilot port 67 of the amplifier valve assembly 43 of the secondary actuator circuit 21, the pilot passage 99, the port 78 and the line 106 into the left chamber 40 of the actuator 19. The discharge pilot flow flows from the right chamber 41 of the actuator 19, the line 107, the port 79, the pilot passage 100, the pilot port 68, the passage 134, the solenoid operated valve 120, the discharge line 136, the discharge port 66, the annular groove 55, the annular groove 55 of the valve assembly 43 of the primary actuator circuit 18, the port 59 and the line 102 into the tank 12. Therefore, the amplifier valve assembly 43 in the primary actuator circuit 18, the amplifier valve assembly 43 in the secondary actuator circuit 21 produces the main supply and discharge flows which are amplified with respect to the pilot supply and discharge flows at a predetermined ratio. The actuator 19 is operated under the force of the working oil under pressure consisting of the main and pilot supply and discharge flows.

The actuators 16 and 19 are returned to the initial position when the right solenoids R and R' of the solenoid operated valves 117 and 120 are energized to switch the valves 117 and 120 to the right position. The direction of the pilot flow is reversed in both the primary and secondary actuator circuits 18 and 21, and flows through the check valves 142 and 142' inserted in parallel with the meter-out flow control valve 127 and the sequencing valve 137, respectively. The main supply flows flow from the annular grooves 54 of the amplifier valve assemblies 43 into the right chambers 39 and 41 of the actuators 16 and 19 while the main discharge flows flow from the left chambers 38 and 40 thereof through the annular grooves 55 of the amplifier valve assemblies 43 into the tank 12. Both the plungers of the actuators 16 and 19 are retracted.

Thus, like the pressure responsive sequencing device shown in FIG. 1, regardless of the direction of the load exerted to the primary actuator circuit 18, the pressure responsive sequencing device 10*a* controls the pilot flows of a small quantity as compared with the maximum flow rate of the main flows in such a way that the operation of the secondary actuator circuit 21 may be started when and only when the operation of the primary actuator circuit 18 has been completed.

So far the present invention has been described with reference to the preferred embodiments thereof, but it is to be understood that various modifications can be effected without departing the true spirit and scope of the present invention as indicated in the appended claims. For instance, a three-step pressure responsive sequencing device may be provided when a switching valve and a meter-out flow control valve are also inserted in the secondary actuator circuit. In like manner, a more-than-three-step pressure responsive sequencing device may be provided based on the same principle.

What is claimed is:

1. A pressure responsive sequencing system, comprising primary actuating circuit means having a primary double-acting fluid actuator and adapted to perform a first circuit operation;

secondary actuating circuit means having a secondary double-acting fluid actuator and adapted to perform a secondary circuit operation, each line of said actuating circuit means including an amplifier valve means having a main flow passage with a main orifice and a pilot pressure responsive supply and exhaust valve inserted therein and a pilot flow passage having a detector orifice inserted therein, the flow rate of the main flow in said main flow passage being amplified with respect to the flow rate in said pilot flow passage in a proportion corresponding to the ratios of the flow cross-section of said main and detector orifices whereby pilot and main flow join prior to entering a respective actuator;

a primary fluid supply line communicating with said pilot passage of said primary circuit means and having a meter-in flow control valve inserted therein;

a primary discharge line communicating with said pilot passage of said primary circuit means and with a reservoir and having a meter-out flow control valve inserted therein;

a secondary fluid supply line communicating said primary fluid supply line with said secondary circuit means; a secondary discharge line communicating with said secondary actuator;

means for initiating said second circuit operation only upon the completion of said first circuit operation, comprising a pressure responsive sequencing valve in said secondary fluid supply line and operative to initiate said second circuit operation, and pressure responsive means for triggering the operation of said sequencing valve only upon completion of said first circuit operation and as a function of a pressure differential between the respective secondary supply and discharge lines;

two position pressure responsive switching valve means interposed between said primary supply and discharge lines and responsive to pressure differences in said primary lines by switching from a first position to a second position in which it communicates the respectively lower-pressure one of said primary lines with said reservoir.

2. A pressure responsive sequencing device as defined in claim 1 wherein the amplifier valve means in the adjacent actuating circuit means are so assembled that the corresponding supply and discharge lines are intercommunicated with each other; and said sequencing and switching valve means are stacked upon the respective amplifier valve means.

* * * * *